US009238980B2

(12) United States Patent
An et al.

(10) Patent No.: US 9,238,980 B2
(45) Date of Patent: Jan. 19, 2016

(54) CRANKCASE VENTILATION DEVICE

(71) Applicant: Mahle International GmbH, Stuttgart (DE)

(72) Inventors: Dimitri An, Stuttgart (DE); Sebastian Barthelmess, Plochingen (DE); Leszek Goerlich, Leonberg (DE); Corinna Krampe, Stuttgart (DE); Niklas Kull, Stuttgart (DE); Yakup Oezkaya, Kornwestheim (DE); Frank Rohde, Kernen (DE); Stefan Ruppel, Heidelberg Emmertsgrund (DE); Harmut Sauter, Renningen (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 14/379,233

(22) PCT Filed: Feb. 12, 2013

(86) PCT No.: PCT/EP2013/052727

§ 371 (c)(1),
(2) Date: Aug. 15, 2014

(87) PCT Pub. No.: WO2013/120820

PCT Pub. Date: Aug. 22, 2013

(65) Prior Publication Data

US 2015/0020785 A1 Jan. 22, 2015

(30) Foreign Application Priority Data

Feb. 16, 2012 (DE) ..... 10 2012 202 405
Nov. 14, 2012 (DE) ..... 10 2012 220 800

(51) Int. Cl.
*F01M 13/04* (2006.01)
*F01M 13/02* (2006.01)

(52) U.S. Cl.
CPC ..... *F01M 13/04* (2013.01); *F01M 13/02* (2013.01); *F01M 2013/0422* (2013.01)

(58) Field of Classification Search
CPC ..... F01M 13/02; F01M 13/04; F01M 2013/0422; F01M 13/021; F01M 2013/026; F01M 13/028
USPC ..... 123/572–574, 41.86, 516, 518, 520, 123/698; 73/114.39; 417/87
See application file for complete search history.

(56) References Cited

U.S. PATENT DOCUMENTS 4,557,226 A 12/1985 Mayer et al.
5,429,101 A * 7/1995 Uebelhoer et al. ..... 123/572

(Continued)

FOREIGN PATENT DOCUMENTS

CH 664798 A5 3/1988
DE 10153120 A1 9/2002

(Continued)

OTHER PUBLICATIONS

English abstract for DE-10128465.

(Continued)

*Primary Examiner* — Erick Solis
*Assistant Examiner* — Carl Staubach
(74) *Attorney, Agent, or Firm* — Fishman Stewart Yamaguchi PLLC

(57) ABSTRACT

A vehicle may include an internal combustion engine having a crankcase and a crankcase ventilation device. The crankcase ventilation device may have at least one oil separating device and an oil return that feeds separated oil back to the crankcase. The vehicle may include a conveying device for driving a fluid other than blow-by gas. The conveying device may also drive the blow-by gas in the crankcase ventilation device.

20 Claims, 9 Drawing Sheets

(56) References Cited

U.S. PATENT DOCUMENTS

| | | | | |
|---|---|---|---|---|
| 6,505,615 | B2 | 1/2003 | Pietschner | |
| 7,025,049 | B2 * | 4/2006 | Pietschner | F01M 13/022 123/572 |
| 7,281,532 | B2 * | 10/2007 | Kakimoto et al. | 123/572 |
| 7,281,535 | B2 | 10/2007 | Mihai et al. | |
| 7,406,961 | B2 * | 8/2008 | Hilpert | B04C 5/28 123/572 |
| 7,958,729 | B2 | 6/2011 | Hilpert | |
| 7,964,009 | B2 * | 6/2011 | Herman | B01D 45/08 55/418 |
| 8,393,315 | B2 * | 3/2013 | Ruppel et al. | 123/574 |
| 8,439,022 | B2 * | 5/2013 | Ruppel et al. | 123/572 |
| 8,470,062 | B2 * | 6/2013 | Herman | F16L 55/24 55/420 |
| 8,485,145 | B2 * | 7/2013 | Palumbo | F02M 25/06 123/41.86 |
| 8,844,507 | B2 * | 9/2014 | Kitayama | F01M 13/00 123/572 |
| 2002/0100465 | A1 * | 8/2002 | Pietschner | F01M 13/023 123/572 |
| 2004/0168415 | A1 | 9/2004 | Hilpert et al. | |
| 2005/0061305 | A1 * | 3/2005 | Pietschner | F01M 13/022 123/572 |
| 2006/0196482 | A1 * | 9/2006 | Kakimoto et al. | 123/519 |
| 2007/0144155 | A1 * | 6/2007 | Moncelle et al. | 60/289 |
| 2007/0267003 | A1 | 11/2007 | Sumser et al. | |
| 2010/0000499 | A1 * | 1/2010 | Braun et al. | 123/559.1 |
| 2011/0073082 | A1 * | 3/2011 | Hattori et al. | 123/574 |
| 2013/0213369 | A1 * | 8/2013 | Doko et al. | 123/574 |
| 2013/0291843 | A1 * | 11/2013 | Kitayama | F01M 13/00 123/574 |

FOREIGN PATENT DOCUMENTS

| | | | |
|---|---|---|---|
| DE | 101 28 465 | A1 | 1/2003 |
| DE | 202008005363 | U1 | 9/2009 |
| DE | 102009030623 | A1 | 12/2010 |
| DE | 102009032835 | A1 | 2/2011 |
| DE | 102009040623 | A1 | 3/2011 |
| EP | 1424133 | A2 | 6/2004 |
| EP | 2009288 | A2 | 12/2008 |
| GB | 2006329 | A | 5/1979 |
| GB | 2441545 | A | 3/2008 |
| WO | WO-02/44530 | A1 | 6/2002 |
| WO | WO-2009080492 | A2 | 7/2009 |

OTHER PUBLICATIONS

English abstract for DE-10153120.
English abstract for DE-102009030623.
English abstract for DE-102009032835.
International Search Report for PCT/EP2013/052727, dated May 22, 2013.
English abstract for DE 102009040623.

* cited by examiner

CRANKCASE VENTILATION DEVICE

CROSS-REFERENCE TO RELATED APPLICATIONS

This application claims priority to German Patent Application No. 10 2012 202 405.0 filed Feb. 16, 2012, German Patent Application No. 10 2012 220 800.3 filed Nov. 14, 2012, and PCT EP/2013/052727 filed on Feb. 12, 2013, the contents of which are hereby incorporated by reference in their entirety.

TECHNICAL FIELD

The present invention relates to a vehicle, preferably a road vehicle.

BACKGROUND

Most motor vehicles are equipped with an internal combustion engine, which generally provides the drive of the vehicle. Such an internal combustion engine, preferably when it is configured as a piston engine, has a crankcase. In the crankcase there is a crankshaft, which is connected via connecting rods to pistons of the individual cylinders of the internal combustion engine. Leaks between the pistons and the associated cylinder walls result in a blow-by gas stream, through which blow-by gas passes from the combustion chambers into the crankcase. To avoid impermissible overpressure in the crankcase, modern internal combustion engines are equipped with a crankcase ventilation device to discharge the blow-by gases from the crankcase. To reduce emissions of pollutants, the blow-by gas is usually fed with the aid of the crankcase ventilation device to a fresh air system of the internal combustion engine, which supplies the combustion chambers of the internal combustion engine with fresh air. There is an oil mist in the crankcase, so the blow-by gas entrains oil. To reduce the oil consumption, a crankcase ventilation device usually has an oil separating device and preferably an oil return, which conducts the separated oil back to the crankcase.

With crankcase ventilation devices, a distinction is drawn between passive systems and active systems. Passive systems use the pressure difference between the crankcase and the vacuum in the fresh air system to drive the blow-by gas. The vacuum in the fresh air system varies greatly depending on the respective operating state of the internal combustion engine. Operating states can also occur in which the available pressure difference is not sufficient to discharge enough blow-by gas. Furthermore, each oil separating device has a flow resistance for the blow-by gas, which makes it more difficult to discharge the blow-by gas. In contrast to this, active systems operate with a conveying device to drive the blow-by gas, so that a sufficient pressure difference can always be provided to discharge the required amount of blow-by gas from the crankcase. Also, the flow resistance of the respective oil separating device can easily be overcome with an active system. However, in active systems the installation outlay is disadvantageous owing to the separate conveying device, since a separate conveying device is associated with correspondingly high costs.

Oil separating devices operate according to various principles. Inertial separators are known, such as cyclone separators, impactors and centrifugal separators, as well as filter devices and electrostatic separation devices. A crankcase ventilation device that operates with an oil separating device configured as an impactor is known for example from WO 2009/080492 A2.

SUMMARY

The present invention is concerned with the problem of suggesting an improved embodiment for a vehicle of the type stated in the introduction, which can in particular be realised in an inexpensive manner. At the same time, a high level of efficiency with regard to the oil separating effect should be realised.

This problem is solved in the present invention in particular by the subject matter of the independent claim. Advantageous embodiments form the subject matter of the dependent claims.

The invention is based on the general concept of configuring the crankcase ventilation device in principle as an active system, a conveying device that is already present in the vehicle in any case being used to drive the blow-by gas, that is, a conveying device that drives a fluid other than blow-by gas in the vehicle. According to this proposal, an active system can thus be realised without a separate, additional conveying device having to be provided in the vehicle. In this manner, the conveying device that is already present in any case gains a double function. Furthermore, no additional installation space is required to accommodate an additional conveying device, since only one suitable fluid connection has to be provided, which manages with a comparatively small amount of installation space.

The crankcase ventilation device expediently has an intake line, which according to an advantageous embodiment connects the crankcase to an intake side of the conveying device. In this manner, the blow-by gas is driven or sucked by means of a vacuum generated by the conveying device on the intake side thereof.

Additionally or alternatively, a pressure line of the crankcase ventilation device can connect a pressure side of the conveying device to the crankcase or to a fresh air system of the internal combustion engine. The conveying device thus conveys the blow-by gas sucked in either back to the crankcase or to the fresh air system, as a result of which the blow-by gas is fed together with the fresh air to the combustion in the internal combustion engine.

In another advantageous embodiment, the above-mentioned intake or pressure line can contain the oil separating device or be connected downstream of the same to a fresh air system of the internal combustion engine. Furthermore, the crankcase ventilation device can according to an advantageous embodiment be equipped with a control device, which allows actuation of a switching valve depending on the current pressure in the fresh air in the region of the connection to the intake line in order to control the connection between the intake line and the conveying device. In other words, the intake of blow-by gas is in the simplest case activated by means of the conveying device only when intake by means of the vacuum in the fresh air line is not sufficient for the purpose. The conveying device therefore does not have to be used continuously to drive the blow-by gas. In particular, the crankcase ventilation device can thus be switched between passive operation and active operation as required.

In particular, a ventilation line can be provided for this purpose, which fluidically connects the crankcase to the fresh air system. Such an oil separating device is advantageously arranged in the ventilation line additionally or alternatively to the above oil separating device. This means that the blow-by gas can in principle pass out of the crankcase via the intake line that connects the crankcase to the intake side of the conveying device and via the ventilation line that connects the crankcase to the fresh air system, in both cases separation of the contained oil taking place by means of the respective associated oil separating device.

The vehicle is preferably configured in such a manner that the blow-by gas can pass out of the crankcase via the intake line or via the ventilation line, combined variants also being conceivable. To this end, a control member or control valve, for example a valve and the like, can be provided in each case, which regulates the sucking in of the blow-by gas by means of the conveying device or the flowing of the blow-by gas via the ventilation line, the control members or control valves advantageously communicating with a control system and being controllable by the latter. The ventilation can thus take place actively via the intake line and by means of the conveying device if for example the pressure difference of the blow-by gas in the crankcase and in the fresh air system of the internal combustion engine is insufficient for passive ventilation. Conversely, the active ventilation by means of the intake line and the conveying device can be reduced or deactivated if the said pressure difference is sufficient to operate the ventilation passively. To this end, in particular pressure measurement devices such as sensors etc. can determine the pressure conditions at the appropriate points and supply them to the control system. Of course, it is also possible to select any desired mixture of active and passive ventilation by means of the control members and control valves.

In advantageous configurations, a pressure regulation valve is provided, which is arranged downstream of an oil mist separating device of the crankcase ventilation system. The crankcase internal pressure can be kept virtually constant by means of this pressure regulation valve. The greater the gas mass present in the crankcase, the greater the volumetric flow exiting from the crankcase. This volumetric flow can be fed directly or indirectly to the fresh air system. The conveying device conducts an additional conveyed volumetric flow into the crankcase. A further gas volume is thus present in the crankcase in addition to the blow-by gas produced. This is however discharged from the crankcase together with the blow-by gas. The volumetric flow that is additionally introduced into the crankcase by the conveying device can thus be disposed of together with the usually arising blow-by gas via the fresh air system.

In particular configurations, an intake line branches off between the pressure regulation valve and the oil mist separating device, which intake line is connected directly or indirectly to the crankcase. The volumetric flow exiting from the crankcase is divided into two part-streams. A first part is fed via the intake line back to the crankcase and thus cleaned again. A second part is fed to the fresh air system. The impurities fed to the fresh air system can be reduced and the crankcase internal pressure can be kept constant by means of this feedback.

According to another advantageous embodiment, the oil separating device can be arranged in the pressure line. It is thereby in particular possible likewise to separate out oil particles that are mixed with the blow-by gas flow in the region of the conveying device.

According to an advantageous development, a bypass line can be provided to bypass the oil separating device, which bypass line connects the pressure line between the conveying device and the oil separating device to the crankcase and contains an overpressure regulation valve. In the event that a particularly large amount of blow-by gas must be discharged, which meets an excessive flow resistance in the oil separating device, the bypass makes pressure relief possible, so that the oil separating device can be bypassed for safety reasons. Since the bypass leads to the crankcase, no oil reaches the environment thereby.

According to another advantageous embodiment, the conveying device can drive the fluid other than the blow-by gas in a main stream, while it drives the blow-by gas in a secondary stream, which can in particular be throttled. In this manner the main function of the conveying device remains the driving of the fluid other than the blow-by gas, since in comparison therewith only a relatively small amount of blow-by gas has to be driven.

An embodiment in which the oil separating device is configured as an impactor or has at least one such impactor is preferred. An impactor is characterised by an extremely simple construction compared to other separating devices, which manages without moving parts. Furthermore, an impactor is virtually maintenance-free. Since a conveying device is used, the blow-by gas stream can be optimally dimensioned for an impactor, as a result of which a sufficiently high separation effect can be realised. The impactor can in particular be a high-pressure impactor.

The respective oil separating device can further have an oil container or oil collector, in which oil separated out of the blow-by gas can be collected. The oil collected in this manner can then flow to the crankcase, in particular by means of the oil return, continuously or in the presence of favourable pressure conditions.

In an advantageous embodiment, the crankcase ventilation device can have an injector pump, which can also be referred to as a suction jet pump. Such an injector pump has a working fluid inlet, a suction fluid inlet and a mixed outlet. The fluid driving the injector pump is the working fluid; it enters at the working fluid inlet and exits at the mixed outlet. The working fluid is generally conducted through a nozzle, preferably a de Laval nozzle, to generate a vacuum in the working fluid flow. This vacuum is connected to the suction fluid inlet, via which any desired fluid is sucked in and mixed with the working fluid, so the fluid sucked in enters at the suction fluid inlet and likewise exits at the mixed outlet together with the working fluid. Such an injector pump thus operates with flow-dynamic forces and manages without an external mechanical drive such as a motor, belt drive or the like.

The working fluid inlet can then expediently be connected to the pressure side of the conveying device via a supply line, while the suction fluid inlet is connected to the crankcase via an intake line. The mixed outlet is then expediently connected to the crankcase via a return line or to the fresh air system of the internal combustion engine. In such an embodiment, the fluid other than the blow-by gas, at least within the circumference of a part-stream, acts to suck in the blow-by gas, the mixture of blow-by gas and the fluid other than blow-by gas, which is preferably a gas, then being fed to the crankcase or to the fresh air system. The stream or part-stream of the fluid other than blow-by gas necessary for driving the blow-by gas is thus treated in the same manner as the blow-by gas itself downstream of the injector pump.

The oil separating device is preferably arranged upstream of the suction fluid inlet of the injector pump. This has the advantage that the oil has already been separated out of the blow-by gas that reaches the injector pump. In addition, any oil or oil droplets that pass through the oil separating device can be made smaller and in particular atomised by means of the injector pump, so that the influences of the oil downstream of the injector pump are reduced. It is however also possible to arrange the oil separating device downstream of the mixed outlet of the injector pump.

An embodiment in which at least one part-stream of the fluid other than the blow-by gas that is conveyed by the conveying device is fed to the oil separating device is particularly advantageous. The fluid other than the blow-by gas that is actually conveyed by the conveying device can thereby also be cleaned of impurities.

The fluid other than the blow-by gas is advantageously a gas, in particular air. This simplifies the feedback of a mixture of the said gas and blow-by gas to the crankcase or to the fresh air system.

According to a further configuration, a circulating conveying device can be provided in the ventilation line or in the suction line, which circulating conveying device acts to circulate the blow-by gas between the crankcase and the oil separating device arranged downstream of the circulating conveying device. To this end, the oil separating device is additionally connected fluidically to the crankcase by means of a connection other than the ventilation line, it being possible for said line to be in particular the oil return. This serves the purpose in particular of allowing the feedback of the oil collected in the oil container of the oil separating device to the crankcase in a pressure-dependent manner. The collected oil can for example pass back to the crankcase if the pressure in the blow-by gas in the crankcase is less than the pressure downstream of the oil separating device.

According to a particularly advantageous embodiment, the conveying device can be a component of a pneumatic braking system of the vehicle. A pneumatic braking system operates with pneumatic pressure to drive brake cylinders. This pneumatic pressure is usually provided with the aid of a pneumatic conveying device. In order that the conveying device does not have to be operated continuously, a pneumatic braking system operates with at least one pressure reservoir. When the conveying device is not used to charge the pressure reservoir, the conveying device can be used to drive blow-by gas. It is also conceivable to connect the pressure line to the pressure reservoir.

Alternatively, the conveying device can be a component of a compressed air system of the vehicle. In modern vehicles, in particular in commercial vehicles, all kinds of systems can be operated with compressed air, for example pneumatic suspension struts.

Alternatively to such an overpressure system, the conveying device can be a component of a vacuum system of the vehicle. An example of this is a vacuum pump of a brake booster of the vehicle, which can in particular be configured as a heavy goods vehicle or a commercial vehicle.

A compressed air system of the vehicle can also be provided in the supply devices of the internal combustion engine. In a preferred configuration, the conveying device is an exhaust gas turbocharger of the internal combustion engine. The exhaust gas turbocharger is driven by the exhaust gas of the internal combustion engine and compresses the air in the fresh air system by means of a compressor. The pressure side of the conveying device therefore corresponds to the compressor side of the exhaust gas turbocharger, it being possible for the corresponding connection to the pressure side in this case to take place via the fresh air system, because the compressor is usually arranged in the fresh air system. In this case, the fluid other than the blow-by gas is therefore the air to be fed to the internal combustion engine. This has the advantage for example that a direct or indirect relationship can thus be created between the loading of the internal combustion engine with air and thus of the blow-by gas on the one hand and the drive of the blow-by gas in the crankcase device on the other hand.

The gas other than the blow-by gas can likewise have impurities, for example in the form of oil droplets. These impurities are separated out of the volumetric flow by the oil separating device of the crankcase ventilation system. Only the impurities that pass through the oil separating device are mixed with the fresh air. Reduced emission of pollutants is thus realised. Furthermore, the volumetric flow containing the impurities is not discharged into the environment in an uncontrolled manner.

According to a further alternative, the conveying device can be a component of a tank ventilation system of the vehicle. In modern motor vehicles, it must be ensured that no fuel vapour passes from the fuel tank into the environment. To this end, tank ventilation devices can be used that can in principle be equipped with a conveying device, for example to be able to check the leak-tightness of the ventilation system and/or of the fuel tank as part of a diagnostic process. The use of the conveying device of the tank ventilation system makes it possible in particular to mix fuel vapours with the blow-by gas and dispose of them via the fresh air system.

In a further variant, the conveying device can be part of a diagnostic device of the fuel tank and in particular be configured as a diagnostic pump. A diagnosis, in particular of the leak-tightness, of the fuel tank of the vehicle takes place by means of the diagnostic device, such as a pressure diagnosis and the like. In particular, the conveying device can thus be a component of such an overpressure or vacuum system.

According to a further embodiment, the conveying device can be part of a diagnostic device of the crankcase ventilation system or of the crankcase ventilation device, the diagnostic pump introducing a test pressure into the crankcase ventilation device, in particular into lines of the crankcase ventilation device, and the leak-tightness of the crankcase ventilation device is tested by means of the pressure profile inside the crankcase ventilation device. The test pressure can therefore be an overpressure or a vacuum.

Further important features and advantages of the invention can be found in the subclaims, the drawings and the associated description of the figures using the drawings.

It is self-evident that the above-mentioned features and those still to be explained below can be used not only in the combination given in each case but also in other combinations or alone without departing from the scope of the present invention.

Preferred exemplary embodiments of the invention are shown in the drawings and are explained in more detail in the description below, the same reference symbols referring to the same or similar or functionally equivalent components.

BRIEF DESCRIPTION OF THE DRAWINGS

In the figures.

DETAILED DESCRIPTION

Figure 1:
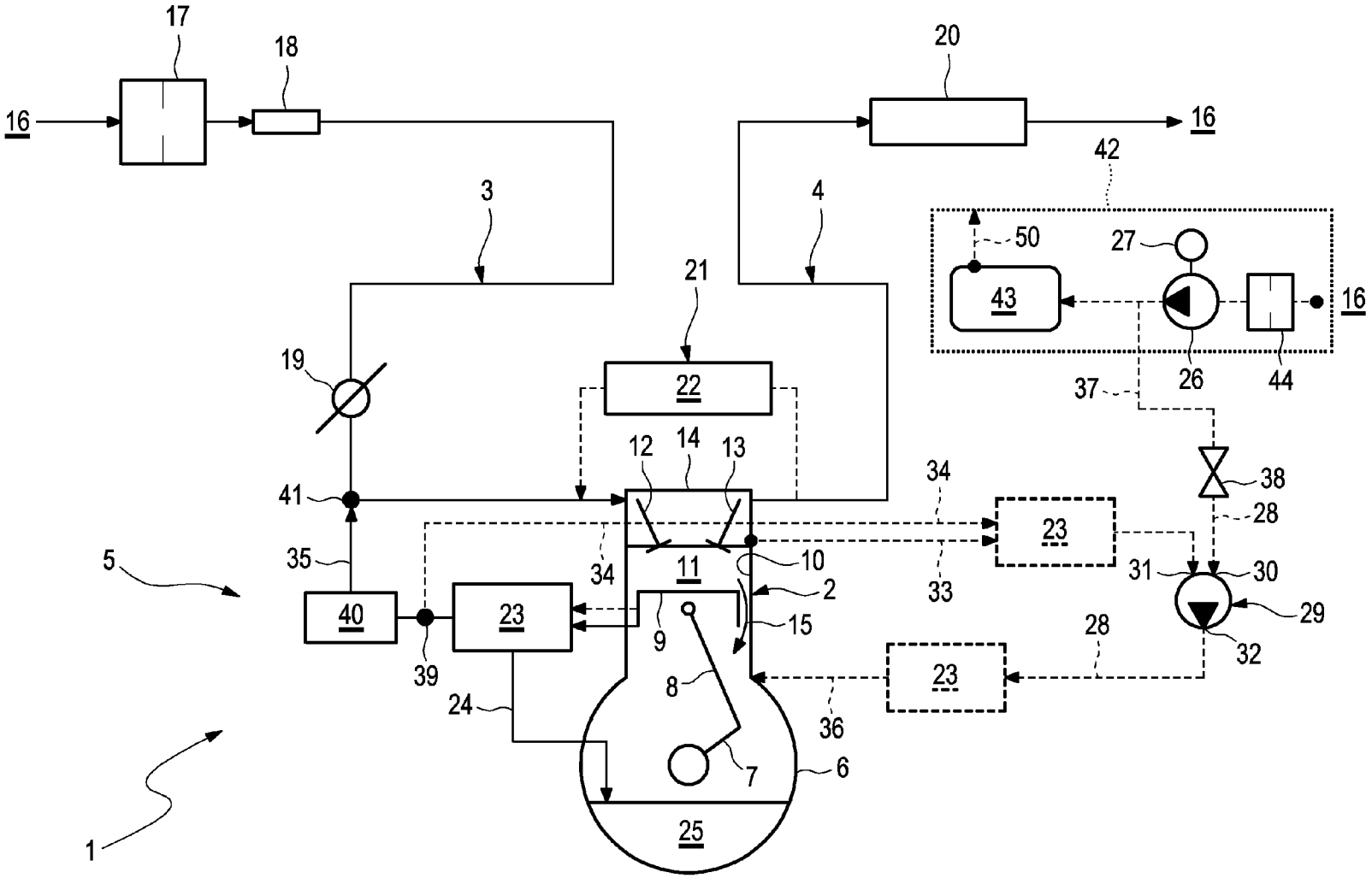
FIG. 1-9 each schematically show a highly simplified, block-diagram-like principle diagram of a motor vehicle having an internal combustion engine and a crankcase ventilation device, in different embodiments.

According to FIGS. 1-9, a motor vehicle 1, which is preferably a road vehicle, comprises an internal combustion engine 2 that is configured as a piston engine, a fresh air system 3, an exhaust system 4 and a crankcase ventilation device 5. The vehicle 1 is highly simplified and only shown in the region of the crankcase ventilation device 5 in FIGS. 1-9.

The internal combustion engine 2 comprises a crankcase 6, in which a crankshaft 7 is arranged, which is connected by means of at least one connecting rod 8 to at least one piston 9, which is arranged in a stroke-adjustable manner in an associated cylinder 10 of the internal combustion engine 2. The respective cylinder 10 encloses a combustion chamber 11. Associated gas exchange valves, namely at least one inlet valve 12 and at least one outlet valve 13 are accommodated in a cylinder head 14. Blow-by gas can pass according to an arrow 15 from the respective combustion chamber 11 past the respective piston 9 into the crankcase 6 during operation of the internal combustion engine 2. The blow-by gas can likewise pass through internal paths into the cylinder head 14.

The fresh air system 3 is used to supply the combustion chambers 11 with fresh air, which is sucked in from an environment 16 for this purpose. The fresh air system 3 contains in the usual manner an air filter 17, an air mass measurement device 18 and a throttle valve 19. The exhaust system 4 conducts combustion exhaust gases away from the combustion chambers 11 and through at least one exhaust gas treatment device 20 in the direction of the environment 16. Furthermore, an exhaust gas return 21 can be provided, which feeds some of the combustion exhaust gases from the exhaust system 4 back to the fresh air system 3. The exhaust gas return 21 expediently contains an exhaust gas return cooler 22, which can be connected to a cooling circuit of the internal combustion engine 2.

The crankcase ventilation device 5 comprises at least one oil separating device 23, with the aid of which oil entrained in the blow-by gas can be separated out of the blow-by gas stream and can be fed back to the crankcase 6 or to a sump 25 via an oil return 24.

The vehicle 1 is moreover equipped with a conveying device 26, which is used in the vehicle 1 to drive a fluid other than blow-by gas. This conveying device 26 is then additionally used to drive the blow-by gas inside the crankcase ventilation device 5. The respective conveying device 26 is expediently equipped with a dedicated drive motor 27, which is preferably an electric motor and can be actuated independently of the operation of the internal combustion engine 2. In principle, however, a mechanical drive coupling between the internal combustion engine 2 and the conveying device 26 is also conceivable, for example by means of a belt drive.

The conveying device 26 can be a pump that generates an overpressure and/or a vacuum. The conveying device 26 can therefore for example be a vacuum pump that is already present in the vehicle 1. Such a vacuum pump can in particular act to boost the braking power of the vehicle 1 or be part of a brake booster device of the vehicle 1.

In the embodiments of FIGS. 1, 2, 4, 7, 8 and 9, the crankcase ventilation device 5 has a pressure line 28, which connects a pressure side of the conveying device 26 to the crankcase 6. In the embodiment shown in FIG. 3, the conveying device 26 is connected on the pressure side directly to the crankcase 6.

In the embodiment shown in FIG. 1, the crankcase ventilation device 5 is equipped with an injector pump 29. This comprises a working fluid inlet 30, a suction fluid inlet 31 and a mixed outlet 32. The injector pump 29 is incorporated into the pressure line 28 in such a manner that the pressure line 28 leads from the working fluid inlet 30 to the mixed outlet 32 through the injector pump 29. The fluid other than the blow-by gas that is conveyed with the aid of the conveying device 26 thus acts as the working fluid of the injector pump 29. The suction fluid inlet 31 is connected to the crankcase 6 or to the cylinder head 14 via an intake line 33. Additionally or alternatively, the suction fluid inlet 31 can be connected via an intake line 34 to a ventilation line 35 of the crankcase ventilation device 5, which leads from the crankcase 6 to the fresh air system 3, expediently downstream of the throttle valve 19. In this respect the suction fluid inlet 31 is also connected via the intake line 34 to the crankcase 6 indirectly via a section of the ventilation line 35. The section 36 of the pressure line 28 that leads back from the mixed outlet 32 to the crankcase 6 can also be referred to as a return line 36. To control the injector pump 29, a switching valve 38 is built into the section 37 of the pressure line 28 that leads from the conveying device 26 to the working fluid inlet 30, which valve can be actuated by means of a corresponding control system (not shown here). The section 37 of the pressure line 28 that leads from the conveying device 26 to the working fluid inlet 30 can also be referred to as a supply line 37.

In the embodiment shown in FIG. 1, the oil separating device 23 is preferably arranged in the ventilation line 35, the intake line 34 expediently being connected to the ventilation line 35 downstream of the oil separating device 23. Downstream of this connection point indicated with 39, the ventilation line 35 can expediently contain a pressure regulation valve 40. If the injector pump 29 is deactivated, which can be realised for example by blocking the section 37 of the pressure line 28, that is, the supply line 37, the vacuum prevailing in the fresh air system 3 downstream of the throttle valve 19 can be used to suck the blow-by gases out of the crankcase 6. In certain operating states of the internal combustion engine 2, however, a sufficient vacuum is not present in this connection region, indicated with 41, between the removal line 35 and the fresh air system 3 to realise satisfactory extraction of blow-by gas. For these states, the switching valve 38 is then actuated by means of the above-mentioned control system to activate the injector pump 29 so that blow-by gas can be extracted by means of the latter.

In FIGS. 1 to 3 and 7 to 9, the pressure regulation valve 40 is situated between the connection point 39 and the ventilation line 35 connected to the fresh air system 3. With increasing volumetric flow exiting from the oil separating device 23, a greater volumetric flow is fed to the fresh air system 3. The crankcase internal pressure thus remains constant. The gas that is conveyed through the injector pump 29 into the crankcase is thus also cleaned and fed to the fresh air system 3 in addition to the usually occurring blow-by gas. The gas volume circulated via the intake line 34 is fed back.

As shown in FIG. 1, such an oil separating device 23 can additionally or alternatively be arranged in the intake line 33 or 34. Additionally or alternatively, it is possible to incorporate such an oil separating device 23 in the pressure line 28, preferably in the section 36, that is, in the return line 36. Furthermore, it is in principle possible to integrate such an oil separating device 23 in the injector pump 29.

In general, the oil separating device 23 can be a centrifuge or a cyclone or a filter or else an impactor. Combinations of the different configurations mentioned are likewise conceivable. Implementation of the oil separating device 23 as an impactor is particularly inexpensive. In particular, such an impactor can be integrated particularly easily in the injector pump 29 owing to its compact shape.

In the embodiment shown in FIG. 1, the conveying device 26 is a component of a compressed air system 42 of the vehicle 1. For example, the vehicle 1 is equipped with a pneumatic braking system or with a pneumatic suspension system or with other systems that are operated with pneumatics. Usually, such a compressed air system 42 can have a compressed air tank 43 downstream of the conveying device 26. An air filter 44 is usually arranged upstream of the conveying device 26. The conveying device 26 can suck air out of the environment 16 and feed it to consumers (not shown here) provided therefor downstream of the tank 43 according to an arrow 50. Such compressed air consumers are for example compressed air brakes, compressed air springs or other compressed air assemblies.

Figure 2:
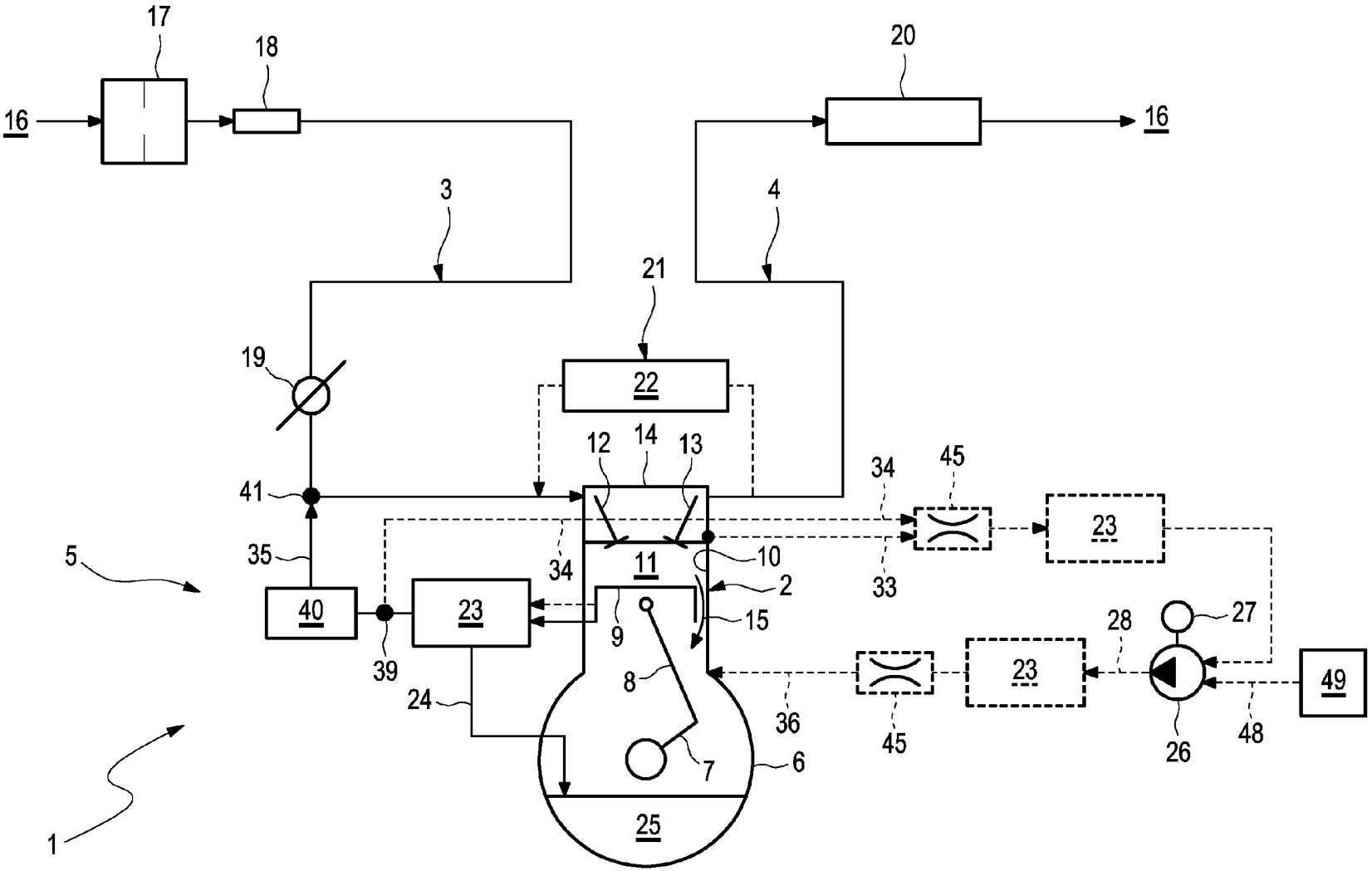
Figure 3:
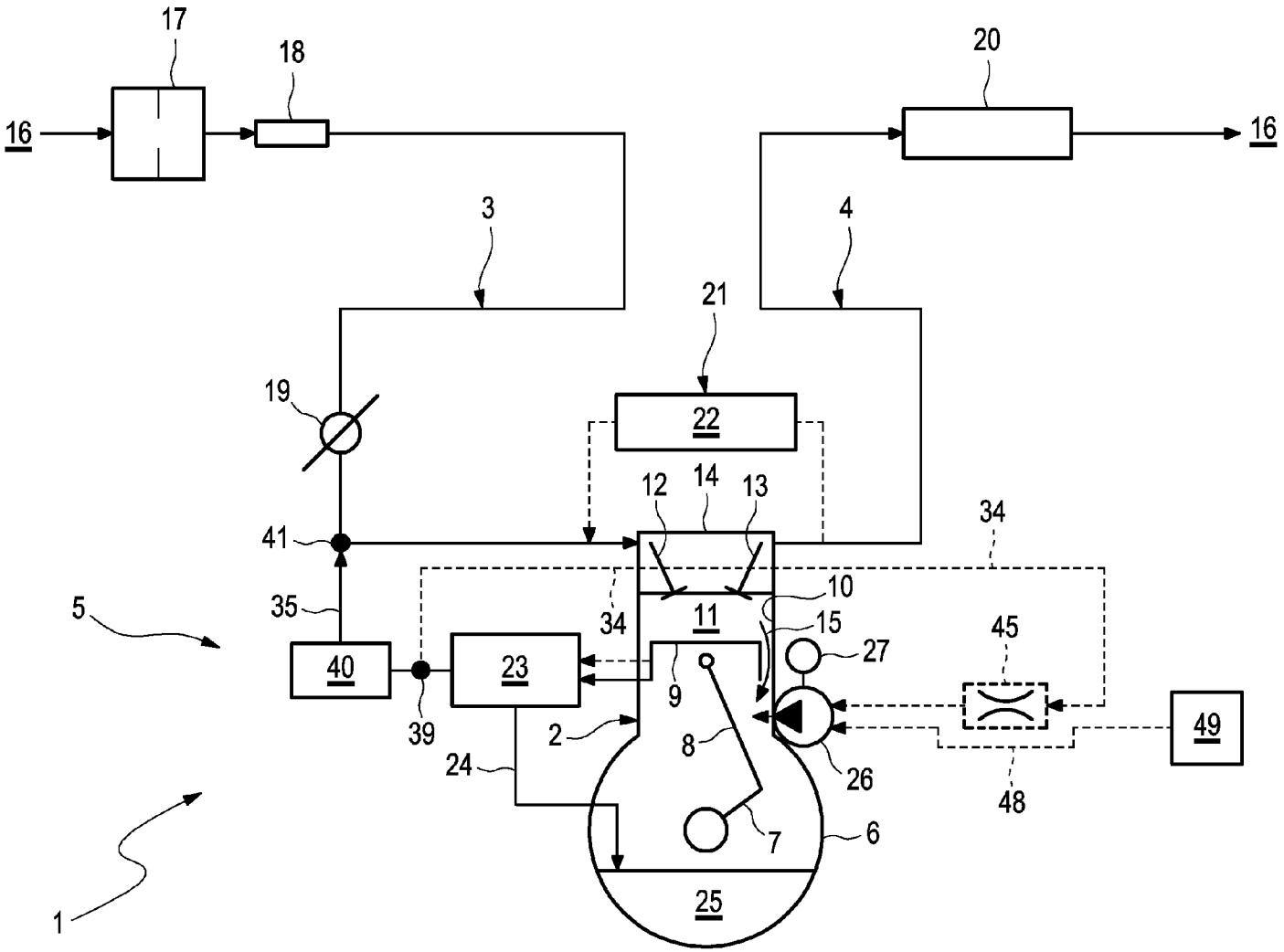
Figure 4:
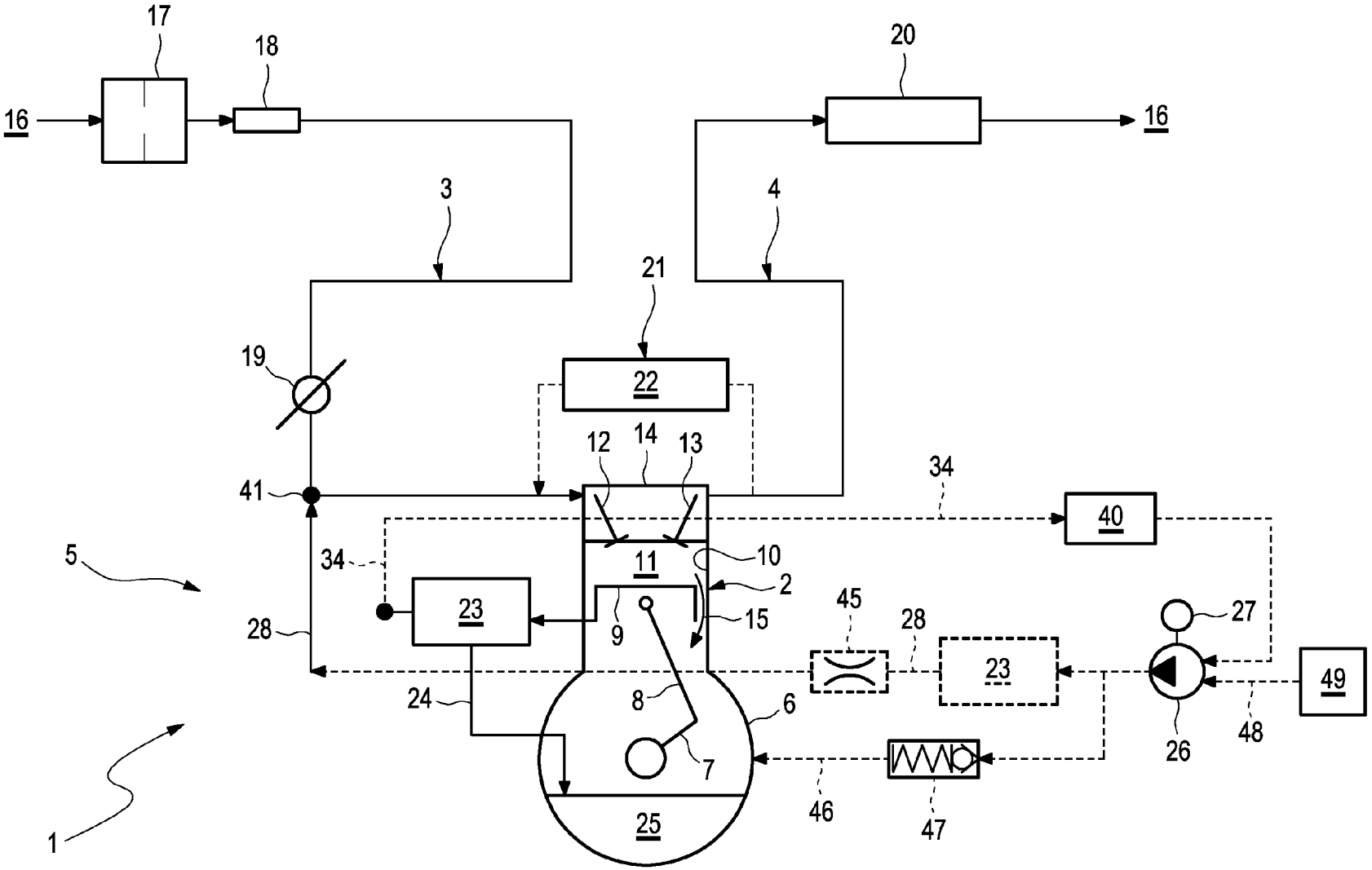

In the embodiments of FIGS. 2-4 and 7 to 9, the two intake lines 33, 34 that are cumulatively or alternatively present are connected to the intake side of the conveying device 26. The respective intake line 33, 34 can contain a throttle 45. If the respective intake line 33, 34 also has an oil separating device 23, the throttle 45 is expediently arranged upstream of the separating device 23. In principle, the throttle 45 can also be arranged downstream of the oil separating device 23. FIGS. 2 and 4 thus each show a variant in which the throttle point 45 is arranged in the pressure line 28 downstream of the oil separating device 23. Alternatively, an embodiment is also conceivable in which the throttle device 45 is structurally integrated in the oil separating device 23, upstream or downstream of the internal separating means, which is preferably an impactor again.

In the embodiment shown in FIG. 3, the oil separating device 23 is again arranged in the ventilation line 35, upstream of the connection point 39 by means of which the intake line 34 is connected to the ventilation line 35. In this case a throttle point 45 is arranged in the intake line 34 to limit the volumetric flow of blow-by gas to a predefined value.

In the embodiment shown in FIG. 4, a bypass or bypass line 46 can also be seen, which allows the oil separating device 23 arranged in the pressure line 28 to be bypassed. In the embodiment shown in FIG. 4, the pressure line 28 is connected to the fresh air system 3 via the connection point 41. A ventilation line 35, as is provided in the variants of FIGS. 1-3, is absent in the embodiment shown in FIG. 4. Thus, in the variant shown in FIG. 4, the intake line 34 is directly connected to the crankcase 6 and can contain an oil separating device 23, which can be provided additionally or alternatively to the oil separating device 23 arranged in the pressure line 28. An overpressure regulation valve 47 is expediently arranged in the bypass line 46, which valve is in this case configured as a spring-loaded non-return valve.

In the embodiments of FIGS. 2-4, the respective conveying device 26 is connected on the intake side via a corresponding connection line 48 to the respective system with which the conveying device 26 is associated. This can be for example a tank ventilation device 49, with the aid of which a fuel tank 61, as is shown for example in FIGS. 7 and 9, can be ventilated. The conveying device 26 can then be used to extract vaporous hydrocarbons from the fuel tank 61 and feed them to the combustion in the combustion chambers 11 via the crankcase ventilation device 5 and finally via the fresh air system 3.

The conveying device 26 is expediently connected in such a manner that it drives the fluid other than the blow-by gas, for example air or hydrocarbon-containing air, in a main stream, while it drives the blow-by gas in a secondary stream, this secondary stream preferably being throttled, as shown for example in FIGS. 2 and 3. The main stream is at least twice as great as the secondary stream.

Furthermore, it is provided in the embodiments of FIGS. 1, 2 and 4 that the conveying device 26 feeds the fluid other than the blow-by gas at least within the circumference of a partstream to the oil separating device 23, which is arranged for this purpose in the pressure line 28. Impurities contained in the fluid other than the blow-by gas, which originate for example from the conveying device 26, can thus also be separated out.

Figure 5:
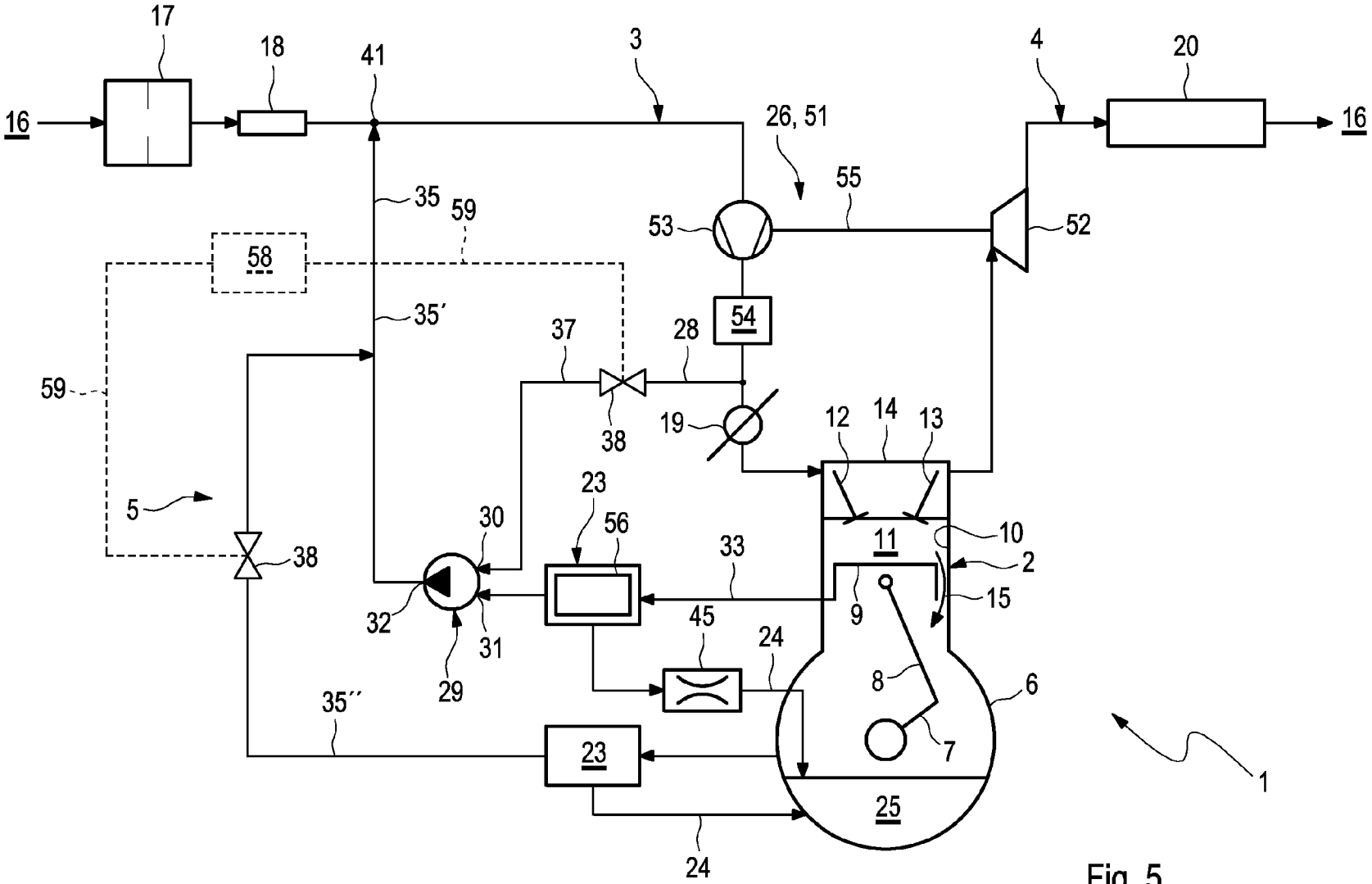

An embodiment is shown in FIG. 5 in which the conveying device 26 is formed by an exhaust gas turbocharger 51 of the internal combustion engine 2, which is arranged with its turbine 52 upstream of the exhaust gas treatment device 20 in the exhaust system 4 and with its compressor 53 upstream of the throttle valve 19 in the fresh air system 3. In addition, a charge air cooler 54 is arranged in the fresh air system 3 downstream of the compressor 53 and upstream of the throttle valve 19 in order to cool the air compressed by the compressor 53. The turbine 52 and the compressor 53 are drive-connected to each other by means of a shaft 55, so the turbine 52 driven by the exhaust gas of the internal combustion engine 2 drives the compressor 53 that compresses the air in the fresh air system 3. In this respect the section of the fresh air system 3 between the compressor 53 and the throttle 19 corresponds to the pressure line 28. Furthermore, such an injector pump 29 is provided, the working fluid inlet 30 of which is connected fluidically to the fresh air system 3 downstream of the charge cooler 54 and upstream of the throttle valve 19 by means of the supply line 37. The injector pump 29 is thus driven by the air of the fresh air system 3 that is compressed by the compressor 53. In addition, the intake line 33 connects the suction fluid inlet 31 of the injector pump 31 to the crankcase 6, while the mixed outlet 32 of the injector pump 31 is connected fluidically to the fresh air system 3 at the connection region 41 via the ventilation line 35'. A second ventilation line 35" opens into the first ventilation line 35' upstream of the connection region 41 to form the common ventilation line 35. The first intake line 33 and the second ventilation line 35" each contain one such oil separating device 23, from each of which one such oil return 24 leads to the sump 25 of the crankcase 6, a throttle 45 additionally being provided in the oil return 24 of the oil separating device 23 arranged in the intake line 33 to limit the flow of the oil into the crankcase 6 or into the sump 25. This oil separating device 23 is thereby equipped with an oil container 56, in which the separated oil can be first collected and then fed to the sump 25.

The blow-by gas can thus pass out of the crankcase 6 both actively by means of the injector pump 29 or the conveying device 26 via the intake line 33 and passively via the second ventilation line 35". In the latter case, however, a sufficient pressure difference is necessary between the connection region 41 and the crankcase 6. Accordingly, the active ventilation only has to be used if such a pressure difference is not present or is not present to a sufficient extent. To this end, such a control member 38 in the form of a switching valve 38 is provided in each case in the supply line 37 and in the second ventilation line 35" downstream of the oil separating device 23, it being possible for pressure regulation valves 40 to be alternatively or additionally provided. With the switching valve 38 arranged in the second ventilation line 35", an arrangement upstream of the oil separating device 23 is likewise possible. These switching valves 38 are connected in a communicating manner to the said control system or to another control system 58, for example by means of cables 59, it being possible for the control system 58 to actuate the respective switching valve 38 individually to be able to change between active and passive ventilation or a mixture thereof as desired. In general, the actuation of the switching valves 38 takes place depending on the said pressure conditions.

The use of the exhaust gas turbocharger 51 as the conveying device 26 has in particular the advantage that when the charge load of the exhaust gas turbocharger 51 increases, a greater amount of blow-by gas is generated, because the cylinder 10 is loaded with a higher pressure. At the same time, a higher output of the injector pump 29 is achieved at full load, so that an equivalent ventilation of the crankcase 6 takes place. Accordingly, the volumetric flow of the blow-by gas decreases with reduced load, which however also means a reduced output of the injector pump 29. The ventilation of the crankcase 6 is thus adapted quasi automatically to the volumetric flow of the blow-by gas produced. Furthermore, a comparatively low branching off of the charge air compressed by the exhaust gas turbocharger 51, in particular of the charge air output, of approx. 5% is necessary for sufficient drive of the injector pump 29.

Figure 6:
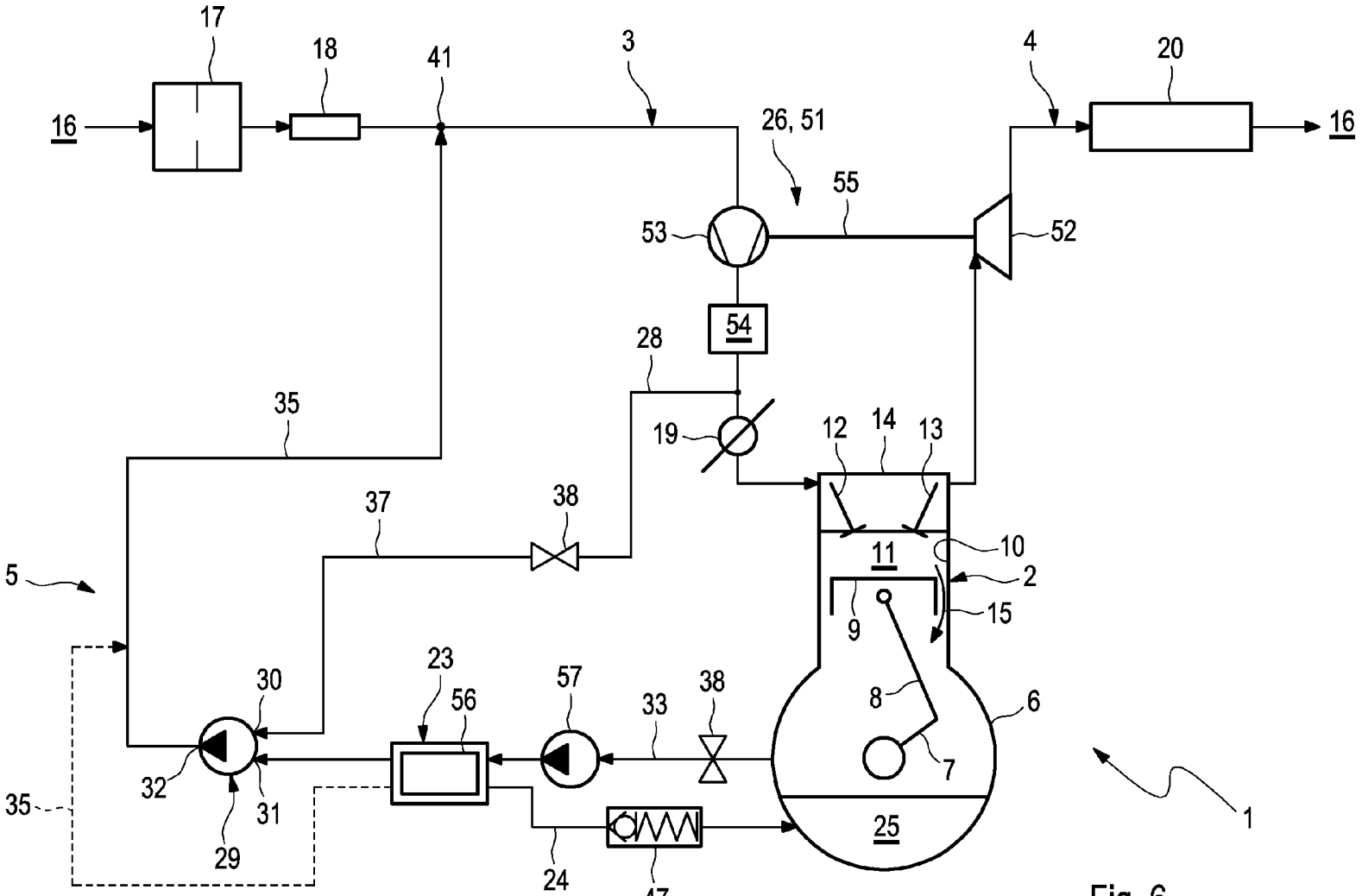

FIG. 6 shows a further embodiment, in which such an oil separating device 23 is provided with such an oil container 56 in the intake line 33. A circulating conveying device 57 is also arranged upstream of the oil separating device 23, which circulating conveying device conveys the blow-by gas out of the crankcase 6 to the oil separating device 23, where the contained oil is at least partially separated out. Then some of the blow-by gas can flow via the oil return 24 back to the crankcase 6, so that a circulation of the blow-by gas is achieved. In this case an overpressure regulation valve 47 is arranged in the oil return 24, which valve prevents the blow-by gas or the separated oil from flowing back, in particular when the pressure in the oil separating device 23 is higher than in the crankcase 6. The oil flows out of the oil separating device 23 or oil container 56 in particular when the pressure downstream of the oil separating device 23 is higher than the pressure in the crankcase 6. The pressure downstream of the oil separating device 23 can for example be determined by the output of the injector pump 29, in particular of the suction force at the suction fluid inlet 31 thereof. In the variant shown with the dashed line of the connection of the oil separating device 23 or intake line 33, in which the oil separating device 23 or the intake line 33 are connected directly to the connection point 41 in the fresh air system 3 by means of the ventilation line 35, the pressure downstream of the oil separating device 23 is in particular defined by the pressure in the region of the connection point 41. Furthermore, a control member 38 in the form of a switching valve 38 is provided upstream of the circulating conveying device 57 to vary and in particular to limit the volumetric flow of the blow-by gas conveyed by the circulating device 47. To this end, the switching valve 47 is connected in a communicating manner to the said control system 58 or to another control system.

Figure 7:
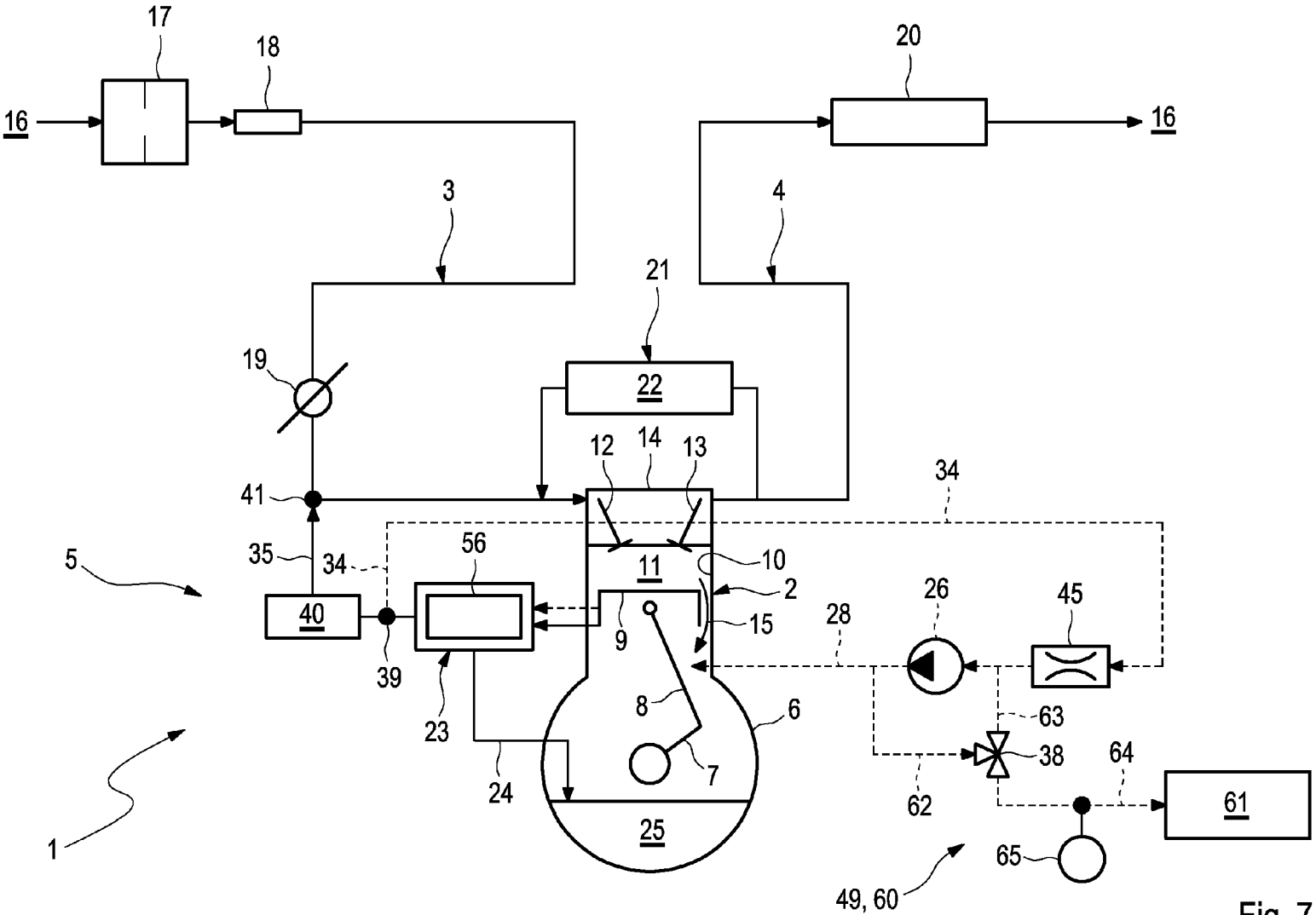

FIG. 7 shows a further embodiment in which the conveying device 26 is part of a diagnostic device 60 for the diagnosis or testing of the leak-tightness of a fuel tank 61 of the vehicle 1. The diagnostic device 60 has a first diagnostic line 62 that opens into the pressure line 28 downstream of the conveying device 26 and a second diagnostic line 63 that opens into the intake line 34 upstream of the conveying device 26 and a third diagnostic line 64 that is fluidically connected to the fuel tank 61. The first diagnostic line 62, the second diagnostic line 63 and the third diagnostic line 64 are connected to each other by means of a control member 38 or control valve 38, which can connect the diagnostic lines 62, 63, 64 to each other respectively or all to each other or can vary and in particular interrupt these connections. Accordingly, the respective connection or the corresponding flow can also be throttled. The diagnosis of the fuel tank preferably takes place in a state of low load or when the internal combustion engine 2 is stopped, when comparatively little or no blow-by gas is produced or occurs, in each case the conveying device 26 conveying at at least partial load. To diagnose the fuel tank 61, the control valve 38 is operated in such a manner that only the first diagnostic line 62 is connected to the third diagnostic line 64. An overpressure that acts as the testing pressure can thus be generated in the fuel tank 61. When a desired or predefined overpressure is reached in the fuel tank 61, the control valve 38 disconnects the connections between the diagnostic lines 62, 63, 64 to keep the overpressure in the fuel tank 61 stable. The pressure in the third diagnostic line 64 or in the fuel tank 61 is then monitored with the aid of a pressure measurement device 65. The pressure measurement device 65 is connected in the present case to the third diagnostic line 64. The pressure measurement device 65 can alternatively or additionally be connected to the fuel tank 61 or arranged in the fuel tank 61. If the pressure determined by the pressure measurement device 65 does not change or does not change substantially or only changes within an expected range, for example owing to the fuel consumption, corresponding leaks can be ruled out. A change in pressure and in particular a fall in pressure, for instance above the expected range, indicates one or more leaks. After the diagnosis, the control valve 38 can be operated in such a manner that ventilation of the fuel tank takes place or continues. The tank ventilation device 49 is therefore part of the diagnostic device 60 or vice versa.

Figure 8:
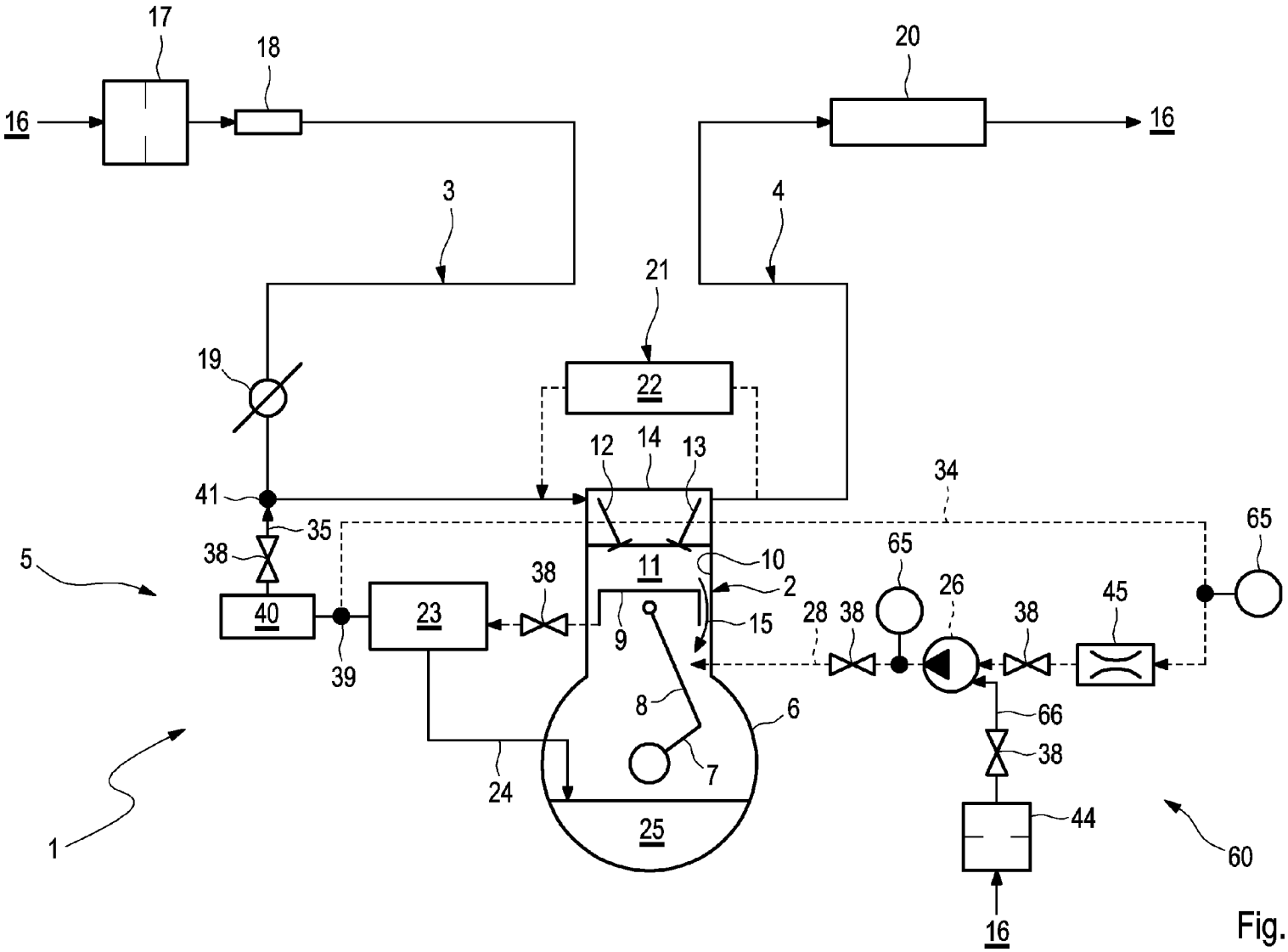

Analogously to the embodiment shown in FIG. 7, FIG. 8 shows a further embodiment in which the diagnostic device 60 acts to diagnose the leak-tightness or to detect leaks in the crankcase ventilation device 5, in particular in the lines 34, 28, the oil separating device 23 and/or the pressure regulation valve 40. To this end, the conveying device 26 introduces a fluid other than the blow-by gas into the crankcase ventilation device 5 and ensures an overpressure in the crankcase ventilation device 5, in particular in the intake line 34 and/or ventilation line 35. Alternatively, the conveying device 26 can also generate a vacuum in the lines 34, 35 and/or the pressure regulation valve 40 and/or the oil separating device 23, as a result of which the testing pressure is the generated vacuum. To this end, the gas volume present in the lines 34, 35 and/or the pressure regulation valve 40 and/or the oil separating device 23 is conveyed into the crankcase 6, as a result of which a vacuum is produced. In this case too, the diagnosis preferably takes place in a state of low load of the internal combustion engine 2 or when the internal combustion engine 2 is stopped. In the case of the overpressure, the fluid other than the blow-by gas is in the present case air, which can be conveyed by the conveying device 26 out of the environment 16 by means of an air line 66, which can be connected to the fresh air system 3 or correspond to the latter, and introduced into the crankcase ventilation device 5. An air filter 44 and a control valve 38 are arranged inside the air line 66. Further control members 38 are arranged directly downstream and upstream of the crankcase 6 to build up and maintain the said overpressure or vacuum in the intake line 34 or overpressure line 28. For example, to generate the overpressure in the intake line 34 and/or the pressure line 28 and/or the pressure regulation valve 40 and/or the oil separating device 23, the control member 38 arranged in the air line 66 is opened until an overpressure builds up in the intake line 34 and/or pressure line 28. Then all the control members 38 in the lines 34, 28 are operated in such a manner that no flow into or out of the section to be investigated is possible. The pressure regulation valve 40 is preferably also closed, alternatively or additionally a further control member 38 being provided in the ventilation line 35, which is closed even before the generation of the overpressure or vacuum, but in any case afterwards. The pressure measurement device 65 is arranged in the section to be investigated or the pressure measurement device 65 is connected with this section. In this case too, pressure variations, in the case of the overpressure therefore a fall in pressure, indicate a leak. To carry out a prognosis for the intake line 34 and the pressure line 28, for example the control members 38 directly on the crankcase 6 and in the air line 66 and the pressure regulation valve 40 and/or the control member 28 in the ventilation line 35 are closed after the overpressure is generated. The overpressure in the intake line 34 and the pressure line 28 is thus blocked in. If a pressure change, in particular a pressure drop, is then measured by means of the pressure measurement device 65 connected to the intake line 34 and/or the pressure measurement device 65 connected to the pressure line 28, this indicates a leaking point or leak in the pressure line 28 or intake line 34. If the intake line 34 and the pressure line 28 are to be tested for leaks separately, then the control member 38 that is arranged directly on the intake side of the conveying device 26 in the intake line 34 is also closed after the overpressure has built up, so that a flow between the intake line 34 and the pressure line 28 is interrupted. Accordingly, a corresponding diagnosis of the intake line 34 can take place with the pressure measurement device 65 connected to the intake line 34 and/or a corresponding diagnosis of the pressure line 28 can take place by means of the pressure measurement device 65 connected to the pressure line 28. If only the intake line 34 is to be investigated for leaks, it is sufficient to close the control member 38 arranged on the intake side of the conveying device 26 instead of the control member 38 arranged on the pressure side of the conveying device 26 in order to build up an overpressure in the intake line 34. Then the control members 38 directly downstream of the crankcase 6 and in the air line 66 are also closed. The diagnosis then takes place by means of the pressure measurement device 65.

Figure 9:
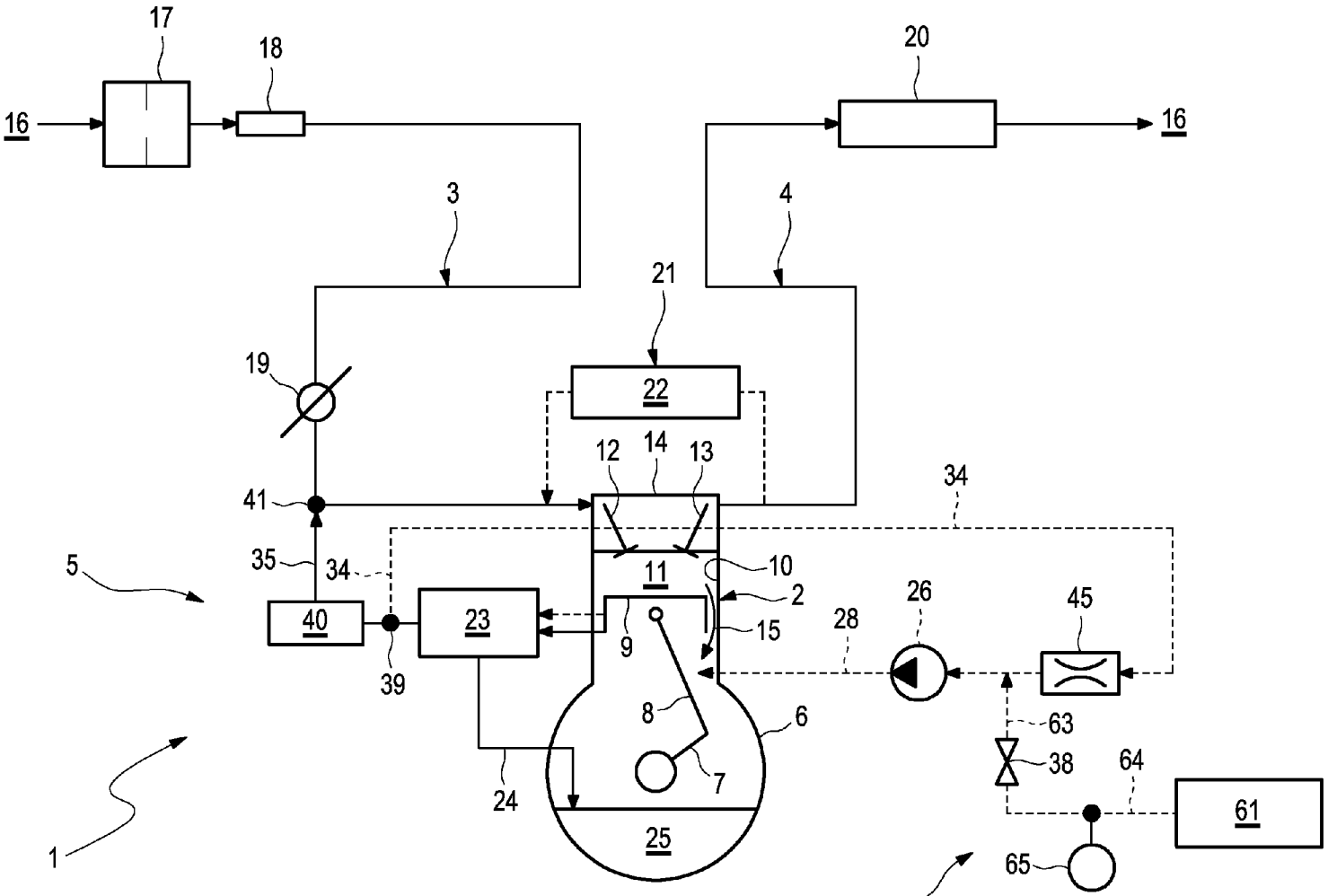

FIG. 9 shows a further embodiment of the vehicle 1. In contrast to the embodiment shown in FIG. 7, in this case a vacuum is generated in the fuel tank 61 to diagnose the fuel tank 61 and the pressure changes are then observed by means of the pressure measurement device 65, in this case an increase in pressure indicating a leak. To this end, the diagnosis device 60 has the third diagnostic line 64 that is connected to the fuel tank 61 and the second diagnostic line 63 that opens on the intake side of the conveying device, which are connected to each other by means of the control member 38. For diagnosis, this control member 38 is opened, as a result of which the conveying device 26 conveys in particular vaporous hydrocarbons out of the fuel tank 61. The control member 38 is opened until a vacuum is produced in the fuel tank 61, whereupon the control member 38 of the diagnostic device 60 is closed. Then the diagnosis can proceed as explained above. After the diagnosis, the control member 38 can be opened until normal ventilation of the fuel tank 61 takes place. In this case too, the tank ventilation device 49 corresponds to the diagnostic device 60 and vice versa.

In the embodiments shown in FIGS. 1 to 3 and 7 to 9, it can be seen that the ventilation line 35 is connected to the fresh air line 3 at the connection point 41. In addition, the intake line 34, via which the blow-by gas is sucked out of the crankcase is connected to the ventilation line 35 at the connection point 39 on the input side, whereby the ventilation line 35 is connected fluidically to the fresh air line 3. This connection point 39 is arranged between the oil separating device 23 and the pressure regulation valve 40. As a result, the blow-by gas extraction can also take place passively, i.e. without the support of the conveying device 26, given sufficiently low pressure conditions in the fresh air line 3. This can also be used to combine active blow-by gas extraction by means of the conveying device 26 and passive blow-by gas extraction as desired. To this end, the switching valve 38 is used, which regulates and can in particular interrupt the connection between the intake line 33, 34 and the conveying device 26. In addition, the pressure regulation valve 40 and/or at least one of the throttles 45 and/or the throttle valve 19 can be used for this purpose. These are for example controlled by means of the control system 58 or another control system. In addition, the vehicle 1 can have at least one pressure measurement device, in order to determine the pressure in the corresponding regions, such as in the fresh air line 3 and/or in the crankcase 6, which can be communicated to the control system 58.

The invention claimed is:

1. A vehicle, comprising:

an internal combustion engine having a crankcase, a crankcase ventilation device, which has at least one oil separating device and an oil return that feeds separated oil back to the crankcase, a conveying device for driving a fluid other than a blow-by gas, wherein the conveying device is also configured to drive the blow-by gas in the crankcase ventilation device, an intake line of the crankcase ventilation device for communicating the blow-by gas and connecting the crankcase to an intake side of the conveying device, wherein the intake line includes the oil separating device and is connected downstream the oil separating device to a fresh air system of the internal combustion engine, and a control device for actuating a control member in response to a current pressure in fresh air in a region of the connection of the fresh air system to the intake line to control the connection between the intake line and the conveying device, wherein the control device actuates the control member to deactivate the driving of the blow-by gas via the conveying device in response to the current pressure exceeding a pressure threshold.

2. The vehicle according to claim 1, wherein a pressure line of the crankcase ventilation device connects a pressure side of the conveying device to at least one of the crankcase and the fresh air system of the internal combustion engine.

3. The vehicle according to claim 2, wherein the oil separating device is arranged in the pressure line.

4. The vehicle according to claim 3, further comprising a bypass line to bypass the oil separating device, the bypass line connecting the pressure line between the conveying device and the oil separating device to the crankcase, wherein the bypass line includes an overpressure regulation valve.

5. The vehicle according to claim 1 wherein the conveying device drives the fluid other than the blow-by gas in a main stream, and drives the blow-by gas in a secondary stream.

6. The vehicle according to claim 1, wherein the oil separating device is at least one of configured as an impactor and has an impactor.

7. The vehicle according to claim 1, wherein the crankcase ventilation device has an injector pump, the injector pump including a working fluid inlet, a suction fluid inlet and a mixed outlet, wherein the working fluid inlet is connected via a supply line to a pressure side of the conveying device, the suction fluid inlet is connected via an intake line to the crankcase, and the mixed outlet is connected via a return line to at least one of the crankcase and a fresh air system of the internal combustion engine.

8. The vehicle according to claim 1, wherein the fluid other than the blow-by gas is divided into a plurality of part-streams, and wherein at least one part-stream of the fluid other than the blow-by gas that is conveyed by the conveying device is fed to the oil separating device.

9. The vehicle according to claim 1, wherein at least one of:

the conveying device is a component of a pneumatic braking system, the conveying device is a component of a compressed air system, the conveying device is a component of a tank ventilation device, the conveying device is a component of a diagnostic device for at least one of diagnosing a fuel tank and the crankcase ventilation device, and the conveying device is an exhaust gas turbocharger of the internal combustion engine.

10. The vehicle according to claim 1, further including an additional oil separating device, the oil separating devices each connected fluidically to the crankcase via such an oil return, wherein one of the oil separating devices is arranged in at least one of the intake line and a pressure line of the crankcase ventilation device connecting a pressure side of the conveying device to at least one of the crankcase and the fresh air system, and the other oil separating device is arranged in a ventilation line that fluidically connects the crankcase to the fresh air system.

11. The vehicle according to claim 10, wherein in each case a switching valve is arranged in (i) the at least one of the pressure line and intake line and (ii) in the ventilation line, wherein the switching valves are controlled via a control system.

12. The vehicle according to claim 1, wherein the oil separating device has an oil container for collecting oil separated out of the blow-by gas.

13. The vehicle according to claim 1, further comprising a circulating conveying device for circulating blow-by gas between the crankcase and the oil separating device.

14. The vehicle according to claim 1, wherein the pressure threshold corresponds to a pressure difference between the region of connection of the fresh air system to the intake line and the crankcase sufficient to convey the blow-by gas when the conveying device is deactivated.

15. The vehicle according to claim 1, wherein the control member blocks the connection between the intake line and the conveying device in response to the current pressure exceeding the pressure threshold.

16. The vehicle according to claim 1, wherein the blow-by gas is discharged from the crankcase via the intake line in response to a pressure difference between (i) the region of connection of the fresh air system to the intake line and (ii) the crankcase when the control device actuates the control member to deactivate the driving of the blow-by gas via the conveying device.

17. A vehicle, comprising:

an internal combustion engine having a crankcase, a crankcase ventilation device, which has at least one oil separating device and an oil return that feeds separated oil back to the crankcase, a conveying device for driving a fluid other than a blow-by gas, wherein the conveying device is also configured to drive the blow-by gas in the crankcase ventilation device, an intake line of the crankcase ventilation device for communicating the blow-by gas and connecting the crankcase to an intake side of the conveying device, wherein the intake line includes the oil separating device and is connected downstream the oil separating device to a fresh air system of the internal combustion engine, and a control device for actuating a control member in response to a current pressure in fresh air in a region of the connection of the fresh air system to the intake line to control the connection between the intake line and the conveying device, wherein the control device actuates the control member between an active state and a passive state, wherein the blow-by gas is driven by the conveying device in the active state, and wherein the blow-by gas is driven by a pressure difference between the fresh air system and the crankcase in the passive state.

18. The vehicle according to claim 17, wherein the oil separating device is at least one of configured as an impactor and has an impactor.

19. The vehicle according to claim 17, wherein the control device actuates the control member to the passive state in response to the current pressure at least one of meeting and exceeding a pressure threshold, and wherein the control device actuates the control member to the active state when the current pressure is below the pressure threshold.

20. The vehicle according to claim 17, wherein the control member blocks the connection between the intake line and the conveying device in the passive state to deactivate the driving of the blow-by gas via the conveying device.

* * * * *